United States Patent [19]

Annand et al.

[11] 3,982,894

[45] Sept. 28, 1976

[54] METHOD OF INHIBITING ACIDIC CORROSION OF FERROUS METALS WITH POLYQUATERNARY AMINO POLYMERS

[75] Inventors: Robert R. Annand, St. Louis; Aldred E. Woodson, Festus, both of Mo.

[73] Assignee: Petrolite Corporation, St. Louis, Mo.

[22] Filed: Dec. 22, 1971

[21] Appl. No.: 211,049

[52] U.S. Cl. ..... 21/2.7 R; 21/2.5 R; 252/148; 252/390

[51] Int. Cl.[2] ..... C23F 11/00; C23F 11/04; C23F 11/14

[58] Field of Search ..... 21/2.7 R, 2.5 R; 252/148, 390; 134/41

[56] References Cited

UNITED STATES PATENTS

| | | | |
|---|---|---|---|
| 325,169 | 9/1965 | Kirkpatrick et al. | 21/2.7 |
| 2,947,703 | 8/1960 | Larsonneur | 21/2.7 R X |
| 3,079,221 | 2/1963 | Andersen | 252/390 X |
| 3,233,963 | 2/1966 | Olin | 21/2.7 R |
| 3,235,596 | 2/1966 | Nordgren et al. | 252/390 X |
| 3,288,555 | 11/1966 | Napier et al. | 21/2.7 R |
| 3,414,521 | 12/1968 | Teumac | 134/41 X |
| 3,488,294 | 1/1970 | Annand et al. | 252/390 X |
| 3,514,251 | 5/1970 | Annand et al. | 21/2.7 R X |
| 3,642,663 | 2/1972 | Greer | 260/567.6 P X |
| 3,669,612 | 6/1972 | Annand et al. | 252/390 X |
| 3,687,859 | 8/1972 | Silverstein | 21/2.7 R X |
| 3,696,049 | 10/1972 | Hauster et al. | 21/2.7 R X |

FOREIGN PATENTS OR APPLICATIONS

| | | |
|---|---|---|
| 955,835 | 1/1957 | Germany |

*Primary Examiner*—Barry S. Richman
*Attorney, Agent, or Firm*—Sidney B. Ring; Hyman F. Glass

[57] ABSTRACT

Polyquaternary amines, for example those formed by reacting mono- or polyamines with a polyfunctional compound, for example difunctional compounds such as organohalides, epihalohydrins, etc., which are capable of both quaternizing and extending the molecular weight of the amine; and to uses for these polyquaternaries, particularly as corrosion inhibitors for highly acid systems.

7 Claims, No Drawings

METHOD OF INHIBITING ACIDIC CORROSION OF FERROUS METALS WITH POLYQUATERNARY AMINO POLYMERS

This invention relates to polyquaternary amines, for example, of the general formula

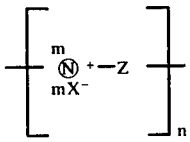

where Ⓝ is a quaternary amine moiety, which is a mono- or a polyamine, Z is a bridging group joining the quaternary amino groups, X is an anion and n is the number of monomeric units comprising the polymer, m is the number of positively charged nitrogens and corresponding negatively charged halogens; and to uses for these polyquaternaries, particularly as corrosion inhibitors for highly acid systems.

One aspect of this invention relates to the reaction products of (1) polyalkylene polyamines and related compounds with (2) polyfunctional compounds, preferably bifunctional, capable of yielding upon reaction (3) a polymer having controlled cross-linking so that the polymer is soluble and/or dispersable in an aqueous system and then optionally reacting this polymer with a quaternizing agent to yield (4) a quaternary polymeric high molecular weight polyalkylenepolyamine.

These reactions may be summarized by the following idealized equations:

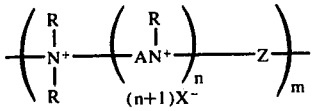

Alternatively, the polyamine can be substituted with R groups prior to reaction with the X - Z - Y compounds so that no final reaction with the quaternizing agent need be employed; or the polyamine can be partially substituted with R groups so that lesser amounts of terminal quaternizing agent need be employed. R is preferably a hydrocarbon group such as alkyl, i.e., methyl, ethyl, propyl, butyl, etc., alkanol such as ethanol, propanol, etc.

The object of the reaction of the bridging group Z with the polyalkyleneamine is to increase the molecular weight of the polyamine, with Z acting as a bridge between the polyamine groups.

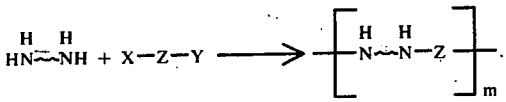

X-Z-Y may be any suitable compound capable of reacting with the polyamine to form the polymer. For example, X and Y may be halogen, epoxy, etc. In addition, X and Y may be the same or different; for example, X and Y may both be halogen, may both be epoxy, one may be halogen and the other epoxy, etc. The following are typical examples.

EPIHALOHYDRIN

Any suitable epihalohydrin may be reacted. Epichlorohydrin is preferred. Other epichlorohydrin compounds include:

1,2-epoxy-4-chlorobutane,
2,3-epoxy-4-chlorobutane,
1,2-epoxy-5-chloropentane,
2,3-epoxy-5-chloropentane, etc.

In general the chloro derivatives are preferred, although the corresponding bromo, iodo, etc., compounds may be employed. In some cases, epidichlorohydrin compounds may be utilized. Mixtures of epihalohydrins may also be employed.

X-Z-Y may be a wide variety of polymerizing compounds where Z may be alkylene, alkenylene, alkynylene, alkaralkylene, an alkyleneether-containing group, an ester-containing group, and amido-containing group, etc.

The following are non-limiting examples:

I. SATURATED DIHALIDES

X-Z-X where Z is alkylene, straight chain or branched, for example $X(CH_2)_nX$ where n is 2–25 or more, for example 2–10, but preferably 2–4. The $-(CH_2)_n-$ may be branched such as where at least one of the H's is a hydrocarbon group such as alkyl, i.e., methyl, ethyl, etc., substituted such as halo, hydroxy, etc.

II. ARALKYLENE DIHALIDES

X-Z-X where Z is aralkylene having for example 8–30 or more carbons, such as 8–20 carbons, but preferably xylylene.

The following are illustrative examples:

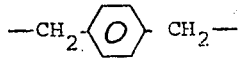

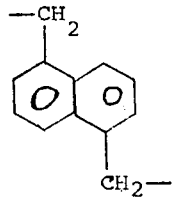

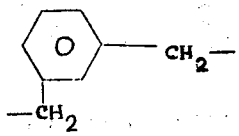

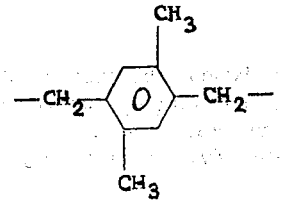

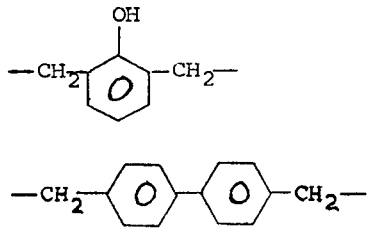

Additional examples of aralkylene radicals include those of the formula $—CH_2—Ar—CH_2$ where Ar is

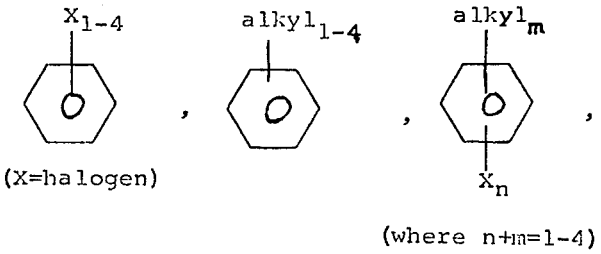

(X=halogen)

(where n+m=1-4)

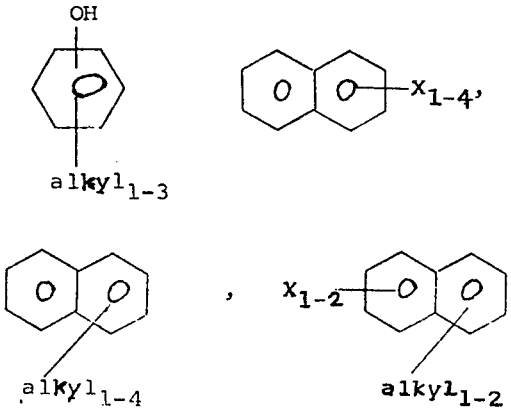

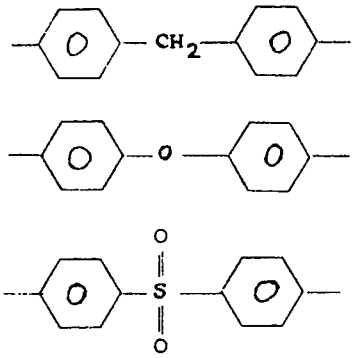

III. ALKYLENE ETHERS

X-A-X where A is an alkyleneether radical $—A(OA)_n—$ where A is alkylene (including cycloalkylene ether radicals) having for example from 1–10 or more carbons such as 1–4, but preferably 2 in each alkylene unit. Typical examples are $Cl—CH_2CH_2—O—CH_2CH_2—Cl$ $Cl—CH_2CH_2(O\ CH_2CH_2)_{1-10}Cl$

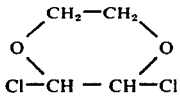

$Cl—CH_2CH_2\ O—CH_2\ O—CH_2CH_2—Cl$

Additional examples of A include groups of the formula $(AO)_n$ where A is

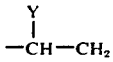

where Y is alkyl, for example

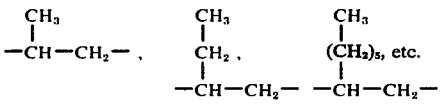

Thus, A can be methylene, polymethylene, ethylene, propylene, butylene, octylene, etc. In addition, $(AO)_n$ may be homo or hetero as to A, to yield for example $(ETO)_a\ (PrO)_b$, or $(PrO\text{-}ETO)_n$;

$—CH_2OCH_2CH_2OCH_2CH_2OCH_2—$ etc.

These compounds also include the formal of ethylene chlorohydrin and bromohydrin, for example, the bisquaternaries prepared from $ClCH_2CH_2OCH_2OCH_2CH_2Cl$, $ClCH_2CH_2OCH_2CH_2OCH_2OCH_2CH_2OCH_2CH_2Cl$ etc.

IV. UNSATURATED DIHALIDES

X-Z-X where Z is an unsaturated aliphatic radical, for example $—CH_2—CH = CH—CH_2—$ $—CH_2—C \equiv C—CH_2—$, etc.

The amines employed herein are polyalkylenepolyamines, for example, of the formula

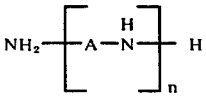

where n is an integer for example to 25 or more, such as 2–10, but preferably 2–5, etc., and A is an alkylene group $—(CH_2)_m—$ where m is 2–10 or more, but preferably ethylene or propylene.

One or more of the hydrogens on the $CH_2$ group may be substituted for example, by such groups as alkyl groups, for example, methyl, ethyl, etc. Examples of A include

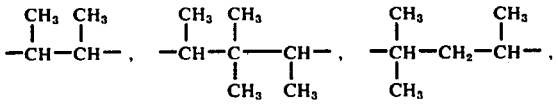

etc.

Examples of polyamines include the following: diethylene triamine, dipropylene triamine, triethylene tetramine, tripropylene tetramine, tetraethylene pentamine, tetrapropylene pentamine, polyalkyleneimines, i.e., the higher molecular weight amines derived from alkyleneimine such as polyethyleneimines, polypropyleneimines, for example having 50, 100 or more alkylene amino units, etc. Mixtures of the above polyamine amines and those polyamines containing both ethylene and propylene groups, for example

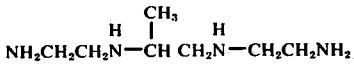

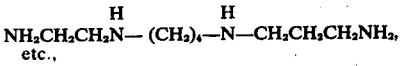

can be employed.

These include the following:

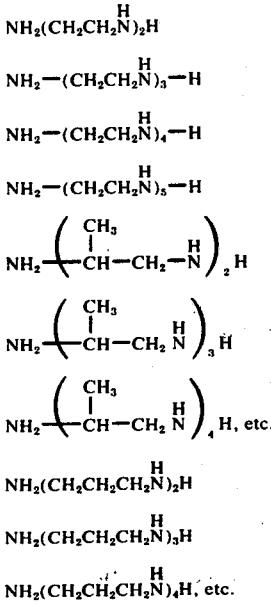

The following equation illustrates the reaction of epichlorohydrin with polyethylenepolyamines, ideally presented:

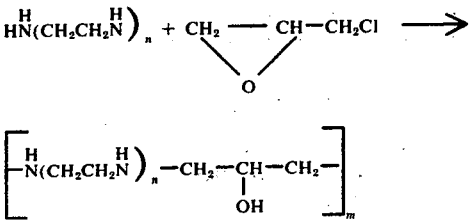

The above is an idealized presentation, but the invention does not exclude other related reactions such as certain amounts of crosslinking, etc.

The reaction with dichlorodiethyl ether may be ideally presented as follows:

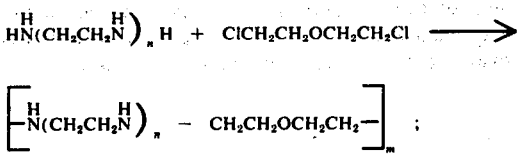

with alkylene dichlorides the reaction is

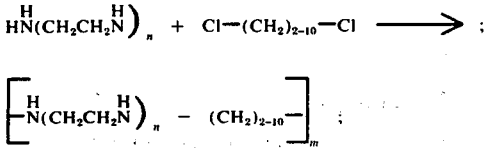

with butene dichloride the reaction is

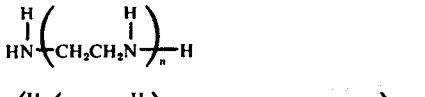

with butyne dichloride the reaction is

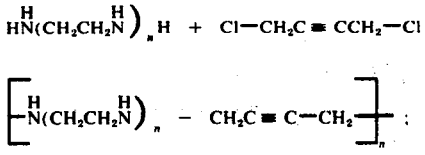

with aralkylarylene the reaction is

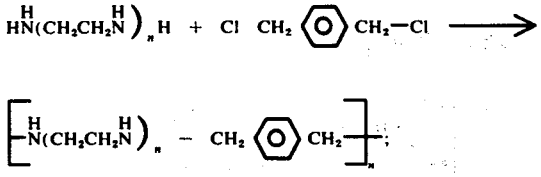

In order to minimize crosslinking it is advisable to react substantially equal molar amounts of polyalkylene polyamines and chain extender X Z Y.

Some of the commercial mixtures of polyalkylenepolyamines contain cyclic diamines, for example Polyamine H (Union Carbide) which contains

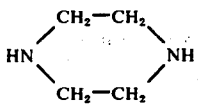

-continued

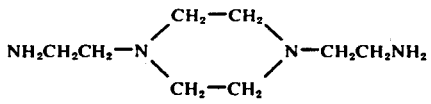

and related compounds which also can be reacted with the chain extender Z according to form polymers, for example according to the following reaction

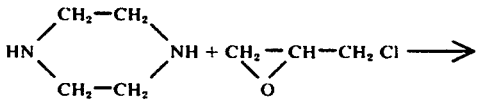

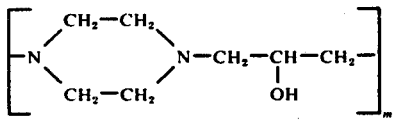

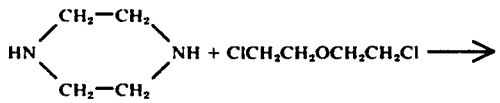

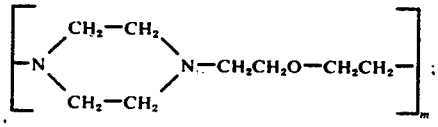

with $Cl(CH_2)_n Cl$

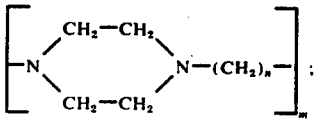

with dichlorobutene

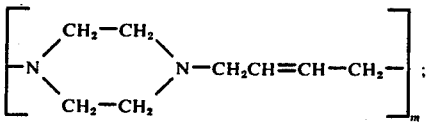

with xylylene dichloride

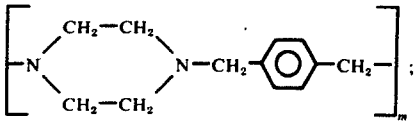

with dichlorobutyne

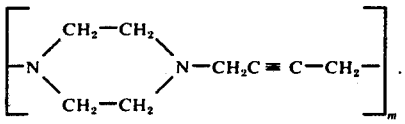

The polyalkylenepolyamine polymer is then quaternized with any suitable quaternizing agent. Preferably the polymer is exhaustively quaternized, i.e., substantially all of the nitrogen atoms are quaternized. However, less than all of the nitrogen groups, such as from 10–99 percent, for example from 25–90 percent, such as from 50–85 percent, may be quaternized where the resulting compound is effective.

The resulting quaternized polymer polyamine should (1) be soluble and/or dispersible in an aqueous medium so that it is readily accessible to the metal surface and (2) have sufficient cationic group so that it has a long adsorptive life, i.e., each atom sticks to the metal for an extended period, since even in the case of the best corrosion inhibitor (i.e., one which is 99 percent + effective) certain metal ions leave the surface of the metal.

In theory, the corrosion inhibitor attaches itself to the metal and protects it as long as it is adsorbed thereon. As the metal corrodes and the points of adsorption are all broken, the corrosion inhibitor will leave the surface and must be replaced with a new corrosion inhibitor molecule. Thus, the more points of attachment the more difficult it is to remove the corrosion inhibitor from the metal surface.

In the case of the polyquaternaries of this invention being ionic, they are soluble in the aqueous medium and being polyquaternaries they have many points of attachment to the metal surface which have to be broken before the corrosion inhibitor is removed from the surface.

With this theoretical view in mind, the variations of the products of the invention will be self-evident. Thus, the initial polyamine may be partially alkylated before polymerization provided suitable polymerization is not prevented. The desired molecular weights of the polymer and the amount and type of quaternization will depend upon the particular system, the particular polymer, etc.

QUATERNIZATION

Any hydrocarbon halide, e.g. alkyl, alkenyl, cycloalkenyl, aralkyl, etc., halide which contains at least one carbon atom and up to about thirty carbon atoms or more per molecule can be employed to alkylate the products of this invention. It is especially preferred to use alkyl halides having between about one to about eighteen carbon atoms per molecule. The halogen portion of the alkyl halide reactant molecule can be any halogen atom, i.e., chlorine, bromine, fluorine, and iodine. In practice, the alkyl bromides and chlorides are used, due to their greater commercial availability. Non-limiting examples of the alkyl halide reactant are methyl chloride; ethyl chloride; propyl chloride; n-butyl chloride; sec-butyl iodide; t-butyl fluoride; n-amyl bromide; isoamyl chloride; n-hexyl bromide; n-hexyl iodide; heptyl fluoride; alpha-ethyl-hexyl chloride; n-octyl bromide; decyl iodide; dodecyl bromide; 7-ethyl-2-methyl-undecyl iodide; tetradecyl bromide; hexadecyl bromide; hexadecyl fluoride; heptadecyl chloride; octadecyl bromide; docosyl chloride; tetracosyl iodide; hexacosyl bromide; octacosyl chloride; and triacontyl chloride. In addition, alkenyl halides can also be employed, for example, the alkenyl halides corresponding to the above examples. In addition, the halide may contain other elements besides carbon and hydrogen as, for example, where dichloroethylether is employed.

The alkyl halides can be chemically pure compounds or of commercial purity. Mixtures of alkyl halides, having carbon chain lengths falling within the range specified hereinbefore, can also be used.

In certain instances excellent corrosion inhibitors are formed without quaternizing agents, particularly where the amine reacted already has secondary and tertiary amino groups. This is particularly applicable to crude amine mixtures which contain mixtures of primary, secondary, tertiary and heterocyclic amino groups.

Thus, where a difunctional compound such as ethylene dichloride, epichlorohydrin, etc., is reacted with such a mixture, a mixture containing quaternary groups is formed. This reaction product may be ideally represented by the formula

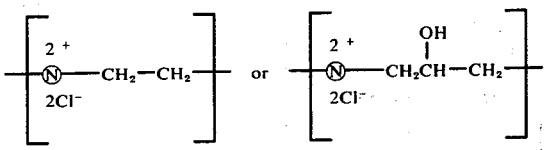

where Ⓝ represents the mixed polyamine. However it is understood that not all the units fit this formula since some of the amino units will not be quaternary groups. Since these compositions are effective as corrosion inhibitors without final treatment with a quaternary agent, less than fully quaternized compositions are included within the scope of the invention. Furthermore, the formula presentation is idealized and meant to represent a mixture which contains quaternary units as well as other units.

In addition to the above, polyquaternaries can also be formed by reacting the difunctional compounds described above with monoamines, for example according to the following general equation

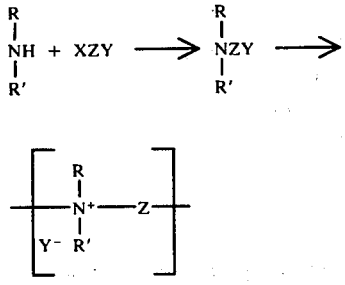

It is noted that by reacting the difunctional compound with a secondary monoamine the polyquaternary is formed directly without necessity of employing additional quaternizing agents as in the case of polyamines. The following are specific examples.

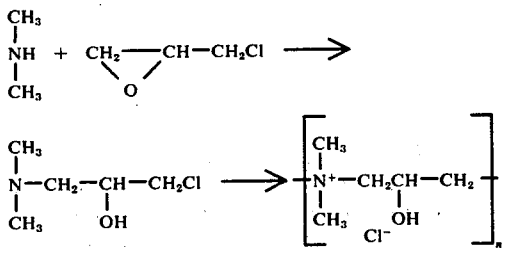

(1)

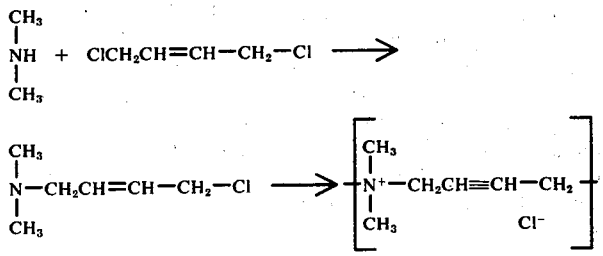

(2)

-continued

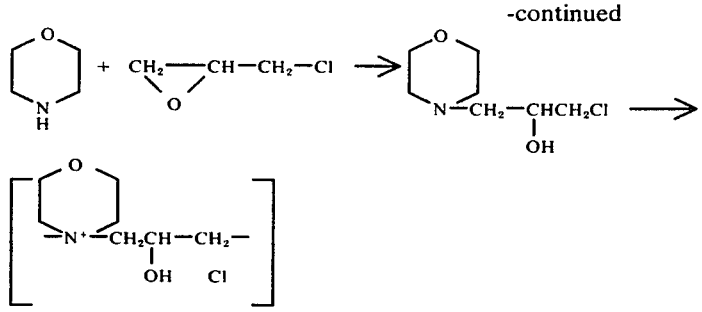

(3)

(4)

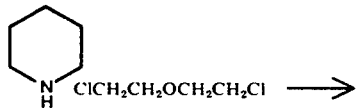

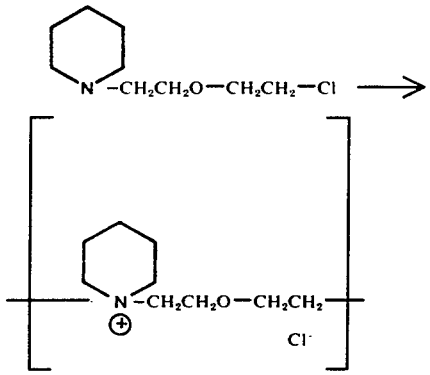

Since the nitrogen of the secondary monoamine can be expanded to a quaternary valence of 4, it is in essence difunctional and therefore can be reacted with difunctional compounds such as epichlorohydrins and dihalides to form polyquaternaries.

Therefore any suitable secondary monoamine can be employed, for example of the formula

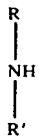

for example where the R's are the same or different. R is an aliphatic, cycloaliphatic, aryl, aralkyl, alkaryl, etc., group. The amine may or may not contain other groups, for example dialkyl amines where the alkyl group has 1–18 or more carbons, alkenyl, alkinyl, etc., for example methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, etc., corresponding alkenyl and alkinyl groups; cyclohexyl, etc.; alkanol such as ethanol, isopropanol, butanol, etc.; hererocyclic such as furfuryl, etc.

The R groups may also be joined to form a cyclic amine, for example

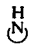

for example

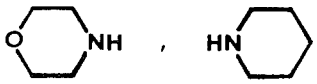

etc.

USE IN ACID SYSTEMS

The compounds of this invention can be employed as corrosion inhibitors for acid systems, for example as illustrated by the following systems:

1. In the pickling of ferrous metals.
2. In the treatment of calcareous earth formations with acids such as HCl mixtures of HCl-HF, etc.
3. In spent sulfuric alkylation acid.
4. In byproduct HCl from the chlorination of organic compounds in the detergent, solvent, rubber, etc., industries.
5. In phosphoric and sulfuric acid systems employed in processing phosphate fertilizer.

6. In spent sulfuric acid from the process of reacting alkenes with alcohols, etc.

The above processes are illustrative. The corrosion inhibitors of this invention can be employed in any strong acid systems such as where $H_2SO_4$, HCl, $H_3PO_4$, HF, etc., are present.

USE AS PICKLING INHIBITORS

This phase of the invention relates to pickling. More particularly, the invention is directed to a pickling composition and to a method of pickling ferrous metal. The term "ferrous metal" as used herein refers to iron, iron alloys and steel.

To prepare ferrous metal sheet, strip, etc., for subsequent processing, it is frequently desirable to remove oxide coating, formed during manufacturing, from the surface. The presence of oxide coating, referred to as "scale" is objectionable when the material is to undergo subsequent processing. Thus, for example, oxide scale must be removed and a clean surface provided if satisfactory results are to be obtained from hot rolled sheet and strip in any operation involving deformation of the product. Similarly, steel prepared for drawing must possess a clean surface and removal of the oxide scale therefrom is essential since the scale tends to shorten drawing-die life as well as destroy the surface smoothness of the finished product. Oxide removal from sheet or strip is also necessary prior to coating operations to permit proper alloying or adherence of the coating to the ferrous metal strip of sheet. Prior to cold reduction, it is necessary that the oxide formed during hot rolling be completely removed to preclude surface irregularities and enable uniform reduction of the work.

The chemical process used to remove oxide from metal surfaces is referred to as "pickling." Typical pickling processes involve the use of aqueous acid solutions, usually inorganic acids, into which the metal article is immersed. The acid solution reacts with the oxides to form water and a salt of the acid. A common problem in this process is "overpickling" which is a condition resulting when the ferrous metal remains in the pickling solution after the oxide scale is removed from the surface and the pickling solution reacts with the ferrous base metal. An additional difficulty in pickling results from the liberated hydrogen being absorbed by the base metal and causing hydrogen embrittlement. To overcome the aforementioned problems in pickling, it has been customary to add corrosion inhibitors to the pickling solution.

The present invention avoids the above-described problems in pickling ferrous metal articles and providing a pickling composition which minimizes corrosion, overpickling and hydrogen embrittlement. Thus the pickling inhibitors described herein not only prevent excessive dissolution of the ferrous base metal but effectively limit the amount of hydrogen absorption thereby during pickling. According to the invention, a pickling composition for ferrous metal is provided which comprises a pickling acid such as sulfuric or hydrochloric acid and a small but effective amount of the compounds of this invention, for example at least about 5 ppm, such as from about 100 to 50,000 ppm, but preferably from about 500 to 15,000 ppm.

Ferrous metal articles are pickled by contacting the surface (usually by immersion in the pickling solution) with a pickling composition as described to remove oxide from their surface with minimum dissolution and hydrogen embrittlement thereof and then washing the ferrous metal to remove the pickling composition therefrom.

USE IN ACIDIZING EARTH FORMATIONS

The compositions of this invention can also be used as corrosion inhibitors in acidizing media employed in the treatment of deep wells to reverse the production of petroleum or gas therefrom and more particularly to an improved method of acidizing a calcareous or magnesium oil-bearing formation.

It is well known that production of petroleum or gas from a limestone, dolomite, or other calcareous-magnesium formation can be stimulated by introducing an acid into the producing well and forcing it into the oil or gas bearing formation. The treating acid, commonly a mineral acid such as HCl, is capable of forming water soluble salts upon contact with the formation and is effective to increase the permeability thereof and augment the flow of petroleum to the producing well.

The following polyquaternaries were tested as corrosion inhibitors for highly acid systems employing the PAIR instrument:

1. The reaction product of Still-bottom polyethylene polyamines (which contain primary, secondary and tertiary amino groups as well as heterocyclic amines) with 1,4-dichlorobutene having the general formula

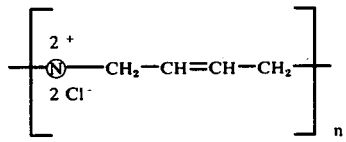

where Ⓝ represents the polyamine.

2. The reaction product of Still-bottom polyethylene polyamines (which contain primary, secondary and tertiary amino groups as well as heterocyclic amines) with epichlorohydrin

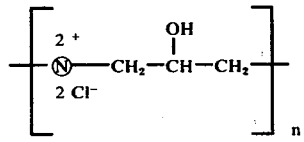

where Ⓝ represents the polyamine.

3. The reaction product of diethylamine and 1,4-dichlorobutene

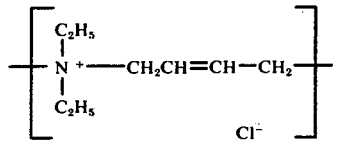

4. The reaction product of morpholine and 1,4-dichlorobutene

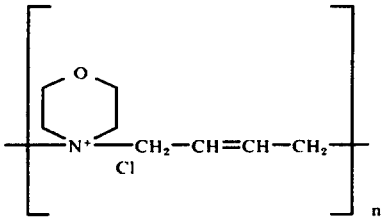

5. The reaction product of diethylamine and epichlorohydrin

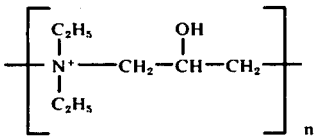

All of the above formulae are idealized formulae.

The corrosion inhibitors were evaluated using sand blasted 1020 mild steel coupons monitored with a polarization resistance meter, a Pair instrument described in U.S. Pat. No. 3,406,101 and by determining the loss in weight for fixed period of time.

The acid was placed in a beaker and the coupons placed in the acid. Corrosion rates were measured at various time intervals and percent protection calculated in the usual manner as follows:

$$\text{Percent protection} = \frac{R_1 - R_2}{R_1} \times 100$$

where $R_1$ is corrosion rate without inhibitor (MPY or Mg/min)

$R_2$ is corrosion in presence of inhibitor (MPY or Mg/min)

The utility of the compositions of this invention is illustrated in the following table.

An important aspect of pickling inhibitors is that they should remain effective in presence of dissolved ferrous ions and ferric ions (from dissolution of the oxide scale). The continued effectiveness of the present compositions is illustrated in the table.

USE AS CORROSION INHIBITORS IN HIGHLY ACID SYSTEM $H_2SO_4$ - 280 g per liter $Fe^{++}$ as $FeSO_4$ - 10 g per liter $Fe^{+++}$ as $Fe_2(SO_4)_3$ - 10 g per liter Inhibitor concentration 0.25% at 200°F

| Product of Sample No. | % Protection |
|---|---|
| 1 | 71.0 |
| 2 | 71.0 |
| 3 | 90.0 |
| 4 | 85.0 |
| 5 | 90.0 |
| Hcl 120 g per liter | |

-continued

| Product of Sample No. | % Protection |
|---|---|
| $Fe^{++}$ as $Fe\ Cl_2$—300 g per liter | |
| Inhibitor concentration 0.25% at 200°F | |
| 4 | 74.5 |
| 5 | 81.0 |

The term "polyquaternary amino polymer" as employed herein and in the claims means a polymer prepared from reaction of an amino, mono- or poly-, with a chain extender, such as epihalohydrin or an organic dihalide, with or without final alkylation, where at least about 10, or preferably about 25 percent of the polymer units, such as about 25–100 percent, for example from about 35–75 percent, but most preferably where at least about 50 percent of the polymer units have quaternary amino units.

We claim:

1. A process of inhibiting corrosion of metals including ferrous metals and alloys thereof in an acidic corrosive medium which comprises contacting said metals including ferrous metals and alloys thereof in said corrosive medium with a polyquaternary amino polymer prepared by reacting a monoamine with an organic dichloride, with or without final alkylation by a quaternizing agent, said polyquaternary amino polymer having at least about 10% of the polymer units with quaternary amino units, said organic dichloride having the general formula Cl—R—Cl and R is $-(CH_2)_n-$ where n is 2–10, $-CH_2CH=CHCH_2-$, $-CH_2C\equiv CCH_2-$,

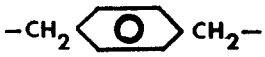

or $-CH_2CH_2-O-CH_2CH_2-$.

2. The process of claim 1 wherein the monoamine is a dialkylamine.

3. The process of claim 2 wherein the dialkylamine is diethylamine and the organic dichloride is 1,4-dichlorobutene, the polyquaternary amino polymer having recurring units of the idealized formula

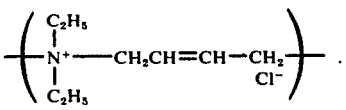

4. The process of claim 1 wherein the monoamine is a heterocyclic amine.

5. The process of claim 4 wherein the heterocyclic amine is morpholine and the organic dichloride is 1,4-dichlorobutene, the polyquaternary amino polymer having recurring units of the idealized formula

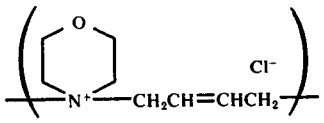

6. A process of inhibiting corrosion of metals including ferrous metals and alloys thereof in an acidic corrosive medium which comprises contacting said metals including ferrous metals and alloys thereof in said corrosive medium with a polyquaternary amino polymer prepared by reacting diethylamine with epichlorohydrin, with or without final alkylation by a quaternizing agent, said polyquaternary amino polymer having at least about 10 percent of the polymer units with quaternary amino units and having recurring units of the idealized formula

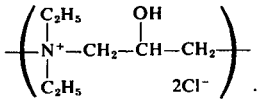

7. A process of inhibiting corrosion of metals including ferrous metals and alloys thereof in an acidic corrosive medium which comprises contacting said metals including ferrous metals and alloys thereof in said corrosive medium with a polyquaternary amino polymer prepared by reacting still-bottom polyethylene polyamines containing primary, secondary, tertiary amino groups and heterocyclic amines with 1,4-dichlorobutene, with or without final alkylation by a quaternizing agent, said polyquaternary amino polymer having at least about 10 percent of the polymer units with quaternary amino units.

* * * * *